US006030136A

United States Patent [19]

Bennett et al.

[11] Patent Number: 6,030,136

[45] Date of Patent: Feb. 29, 2000

[54] EXPENDABLE MASS RETENTION DEVICES FOR EXPELLANT HOLDERS

[75] Inventors: Harold E. Bennett, Wyckoff; Joseph S. Wargo, Mountain Lakes, both of N.J.

[73] Assignee: Estee Lauder Companies, New York, N.Y.

[21] Appl. No.: 09/009,418

[22] Filed: Jan. 20, 1998

Related U.S. Application Data

[63] Continuation of application No. 08/421,657, Apr. 13, 1995, abandoned.

[51] Int. Cl.[7] ..... B43K 21/08

[52] U.S. Cl. ..... 401/78; 401/87

[58] Field of Search ..... 401/78, 87, 77, 401/68, 72, 55, 170; 403/378

[56] References Cited

U.S. PATENT DOCUMENTS

| | | | |
|---|---|---|---|
| 636,454 | 11/1899 | Rubira . | |
| 1,557,608 | 10/1925 | Perkins . | |
| 2,302,473 | 11/1942 | Reichenbach | 401/78 |
| 2,367,992 | 1/1945 | Beris | 35/59 |
| 2,590,329 | 3/1952 | Kromray | 132/79 |
| 2,678,128 | 5/1954 | Sherman | 206/56 |
| 3,146,881 | 9/1964 | Metreaud et al. | 206/56 |
| 3,175,680 | 3/1965 | Fuglsand-Masden et al. | 206/56 |
| 3,214,012 | 10/1965 | Mack | 206/56 |
| 3,980,805 | 9/1976 | Lipari | 403/378 X |
| 3,991,777 | 11/1976 | Powers et al. | 132/88.7 |
| 4,579,134 | 4/1986 | Moore | 132/88.5 |
| 4,647,241 | 3/1987 | Weber | 403/378 X |
| 4,664,547 | 5/1987 | Rosenwinkel | 401/175 |
| 4,950,094 | 8/1990 | Yorks | 401/75 |
| 5,560,727 | 10/1996 | Vaupel | 401/78 |

FOREIGN PATENT DOCUMENTS

| | | | |
|---|---|---|---|
| 1008675 | 5/1952 | France . | |
| 1085118 | 1/1955 | France . | |
| 1111707 | 3/1956 | France . | |
| 33 19 031 | 11/1984 | Germany . | |
| 731013 | 6/1955 | United Kingdom . | |
| 2143212 | 2/1985 | United Kingdom . | |
| WO 92/12651 | 8/1992 | WIPO | A45D 40/06 |

*Primary Examiner*—David J. Walczak
*Attorney, Agent, or Firm*—Pennie & Edmonds LLP

[57] ABSTRACT

The present invention provides retention devices for securing an expendable mass, e.g., lipsticks, deodorants, antiperspirants, glue or the likes, to an expellant holder by providing one or more spikes fixedly attached to a receiving cup of the expellant holder such that the one or more spikes penetrate the expendable mass to anchor the mass to the receiving cup.

10 Claims, 2 Drawing Sheets

EXPENDABLE MASS RETENTION DEVICES FOR EXPELLANT HOLDERS

CROSS-REFERENCE TO RELATED APPLICATIONS

This application is a continuation of U.S. application Ser. No. 08/421,657, filed Apr. 13, 1995, now abandoned.

BACKGROUND OF THE INVENTION

The present invention relates to expellant holders for expendable substances such as lipsticks, lip balms, deodorant sticks, anti-perspirant sticks, glue sticks and other applicative cosmetics.

The prior art holder for expendable substances and the likes generally comprises a cylinder having a rotatable member disposed at its bottom end. A mass of expendable substance such as lipstick is received inside a receiving cup and is normally disposed within the cylinder. Rotation of the rotatable member relative to the cylinder causes a mechanism inside the cylinder to advance the expendable mass longitudinally away from the rotating member such that the mass is exposed above the cylinder. In this manner, the exposed portion of the mass is available for application.

The problem encountered with the prior art expellant holder is that the expendable mass is only secured to the receiving cup by the frictional force acting on the contact surfaces between the receiving cup and the expendable mass, as disclosed in U.S. Pat. No. 3,9991,777 to Powers et al. and U.S. Pat. No. 3,214,012 to Mack. To increase the contact surface areas, longitudinally extending internal ribs are added on the receiving cup as disclosed in U.S. Pat. No. 3,175,680 to Fuglsang-Madsen et al. and U.S. Pat. No. 4,579,134 to Moore.

It has been found that the frictional force between the contacting surfaces is insufficient to retain the expendable mass in the receiving cup when the expellant holder is exposed to sudden shocks, e.g., when the holder is dropped on its top end. Such shocks may dislodge the expendable mass from the receiving cup and the expellant holder is rendered inoperable. This problem is magnified when the expendable substance disposed in the receiving cup is relatively heavy, e.g., deodorant sticks. While the internal ribs may offer additional frictional resistance against shocks, they do not provide a different type of resistance. Additionally, due to the aesthetic aspects of the expellant holders, it is necessary that any additional resisting force does not disturb the aesthetic appearance of the expellant holders.

Thus, there continues to be a need in the art for an expellant holder including lipstick holder that is capable of resisting forced separation of the expendable mass from the holder caused by mechanical shocks.

SUMMARY OF THE INVENTION

The present invention provides an expellant holder having a mechanism for resisting forced separation of the expendable mass from the expellant holder. The holder comprises a receiving cup for holding the expendable mass, wherein the receiving cup is slideably disposed within the expellant holder. The holder also has a means for advancing the receiving cup and expendable mass until at least a portion of the expendable mass has advanced outside the expellant holder and for retracting the receiving cup and expendable mass within the expellant holder. The holder further comprises spikes fixedly attached to the receiving cup which penetrate the expendable mass through corresponding apertures defined by the receiving cup.

The spikes can be disposed on a snap ring, and the snap ring is received on the receiving cup such that the spikes penetrate the expendable mass through the apertures. The receiving cup can also have a channel to receive the snap ring. Additionally, the spikes can also be disposed on arms that are fixedly attached to the receiving cup, and each arm has a cam surface disposed opposite from the spike, wherein the cam surface cooperates with a sidewall of the expellant holder to drive the spike into the expendable mass.

It is therefore an object of the present invention to provide an expellant holder that can resist forced separation of the expendable mass from the receiving cup said holder has a mechanism for securing the expendable mass to the receiving cup in addition to the frictional force acting between the mass and the receiving cup.

It is another object of the present invention to provide an expellant holder having an additional securing mechanism while maintaining the aesthetic appearance of the expellant holder.

DETAILED DESCRIPTION OF THE PREFERRED EMBODIMENTS

Expellant holder of the present invention can be used with a number of expendable substances, i.e., substances that can be applied onto a surface such as skin, fabrics, papers and the likes, and leave a thin film of the substance on said surface. Such expendable substances include, but are not limited to, lipsticks, lip balms, deodorants, anti-perspirants, glue and other cosmetics. For simplicity lipstick will be used when describing the present invention, but it will be noted that the present invention is not restricted to only lipstick or the products listed above.

Figure 1:
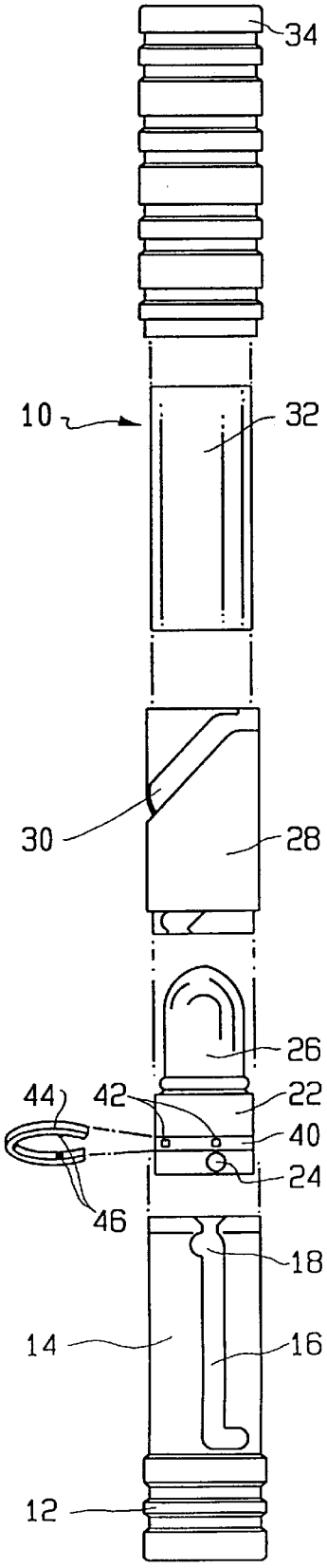
FIG. 1 is an exploded view of an embodiment of the retaining device for an expellant holder of the present invention with a snap ring.

Now referring to the Figures, wherein like numerals are used to designate like parts and according to FIG. 1, lipstick holder 10 is depicted in an exploded view to show its individual components. Among other things, holder 10 comprises a rotatable base 12 and slotted cylinder 14 fixedly attached to rotatable base 12. Slotted cylinder 14 defines at least one longitudinal slot 16. Slot 16 also has a transversal segment 18 defined at the top end of cylinder 14. Slot 16 may also have another transversal segment defined at the bottom of cylinder 14. A lipstick cup 22 having at least one lug 24 is slidingly received inside slotted cylinder 14 wherein the at least one lug 24 is disposed within and protrudes outside of the at least one longitudinal slot 16. Cup 22 holds a lipstick mass 26 within the cup and when cup 22 is disposed at the bottom end of slotted cylinder 14 the entire lipstick mass is contained within slotted cylinder 14. When receiving cup 22 is at or near the top of slotted cylinder 14, at least a portion of lipstick mass 26 is exposed beyond cylinder 14 to allow the application of lipstick on the lips. Also when receiving cup 22 is at the top of cylinder 14, lug 24 is received in slot 18 to help keep lipstick mass 26 in the exposed position when pressure is applied on top of the lipstick mass.

Spiral cylinder 28 is rotationally disposed to the outside of slotted cylinder 14, such that the at least one lug 24 is also received in at least one spiral channel 30 defined by spiral cylinder 28. When base 12 is rotated, slotted cylinder 14 also rotates relative to spiral cylinder 28. Thus, as lug 24 moves along spiral channel 30, lug 24 is also moved longitudinally along channel 16.

Further, hollow outer cylinder or shell 32 is disposed concentrically outside of spiral cylinder 28. It is preferred that outer cylinder 32 and spiral cylinder 28 are not rotatable relative to each other. Outer cylinder 32 also makes easier for the user to advance lipstick mass 26 for application. By grasping outer cylinder 32 with one hand and base 12 with the other and rotating these two components relative to each other, the user advances lipstick mass 26 upward without touching and interfering with the motion of lug 24 along spiral channel 30 and slot 16. Also, outer cylinders 32 and spiral cylinder 28 can be made integral to each other, i.e., outer cylinder 32 may be constructed with a thickness sufficient to define one or more spiral channels on its inside surface while leaving the outer surface uninterrupted.

Finally cap 34 fits over cylinders 14, 28 and 32 and also onto base 12 to keep dust, moisture and the likes from contaminating lipstick mass 26 such that cap 34 normally stays affixed to base 12 until the user pulls cap 34 off of base 12. As shown in FIG. 1, base 12 and cap 34 may have decorative design or pattern on the outside for aesthetic effect or they may also possess non-cylindrical shapes.

Lipstick mass 26 is retained inside of lipstick cup 22 by frictional force acting on the contact surfaces between the outside of the lipstick mass and the inside of cup 22. Frictional force is not sufficient to hold mass 26 inside cup 22 when shock is applied to holder 10, e.g., when holder 10 is dropped with cap 34 striking the ground first. The frictional force can be increased by increasing contact surface area between the receiving cup and the lipstick mass. An increase in contact surface area can be achieved by adding longitudinal ribs on the inside of cup 22.

In the present invention, in addition to frictional force, lipstick mass 26 can be anchored to receiving cup 22 by spikes that are fixedly connected to the receiving cup and penetrate the lipstick mass at locations above the bottom end of the lipstick mass.

Figure 2:
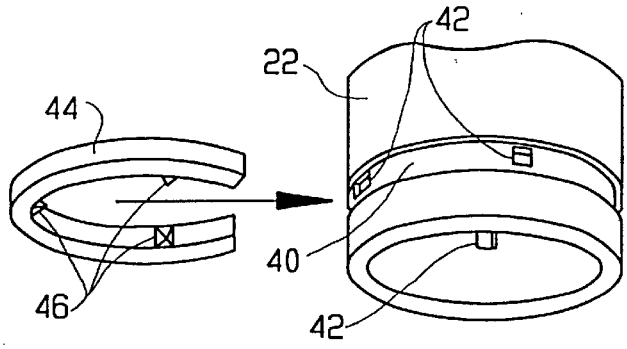
FIG. 2. is an elevated view of the retaining device of the embodiment shown in FIG. 1.

As shown in FIG. 1 and particularly in FIG. 2 a channel 40 is defined on cup 22. A plurality of apertures 42 are defined on channel 40 exposing lipstick mass 26. Arcuate snap ring 44 is provided to be received within channel 40. Arcuate snap ring 44 has disposed on its inner surface a plurality of spikes 46 which correspond to the plurality of apertures 42. Ideally, snap ring 44 is made out of a resilient material such as plastic or metal and has a diameter slightly smaller than that of channel 40 so that ring 44 remains in place after being disposed within channel 40. After arcuate snap ring 44 is received within channel 40, spikes 46 penetrate lipstick mass 26 through apertures 42 to anchor the lipstick mass to the receiving cup to prevent slippage or movement of the lipstick mass relative to the receiving cup. It will be noted that snap ring 44 can be received on cup 22 without channel 40 as long as spikes 46 penetrate lipstick mass 26 through apertures 42.

Figure 3:
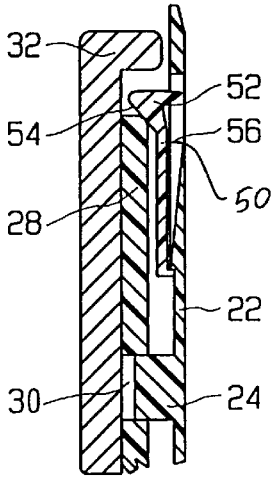
FIG. 3 is a partial cross-sectional view of another embodiment of the retaining device of the present invention with arms.
Figure 4:
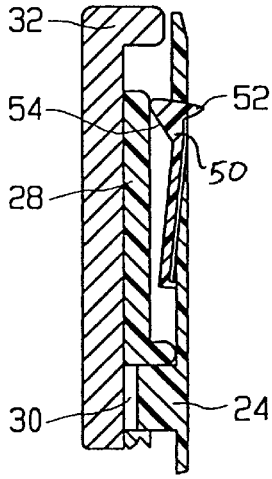
FIG. 4 is another partial cross-sectional view of the embodiment shown in FIG. 3.

Another embodiment of the present invention is depicted in FIGS. 3 and 4. In this embodiment cup 22 contains a plurality of arms 50. Arm 50 has an inwardly facing spike 52 and a cam surface 54 located opposite from spike 52. Cup 22 further defines a plurality of apertures 56 which corresponds to the plurality of spikes 52. As shown in FIG. 3, spike 52 is disposed above spiral cylinder 28 but is within outer cylinder 32 so that the sight of spikes 50 will not adversely effect the aesthetics of holder 10. Also, lug 24 is disposed within channel 30 of spiral cylinder 28. For clarity, slotted cylinder 14 is not shown in FIGS. 3 and 4. Further, arm 50 may also be disposed within slot 16 of slotted cylinder 14 and above lug 24. As depicted in FIG. 4, as cup 22 is withdrawn downwardly, cam surface 54 slides along the top of spiral cylinder 28 and spike 52 is driven through aperture 56 to penetrate into and anchor the lipstick mass. Also as shown in FIG. 4, the inner wall of spiral cylinder 28 cooperates with cam surface 54 to keep spike 52 in the anchored configuration. It will be noted that after spike 52 is initially driven into the lipstick mass, it will remain embedded even if spike 52 is subsequently raised above the top of spiral cylinder 28, because there is no force acting to remove spike 52 from the lipstick mass.

Figure 5:
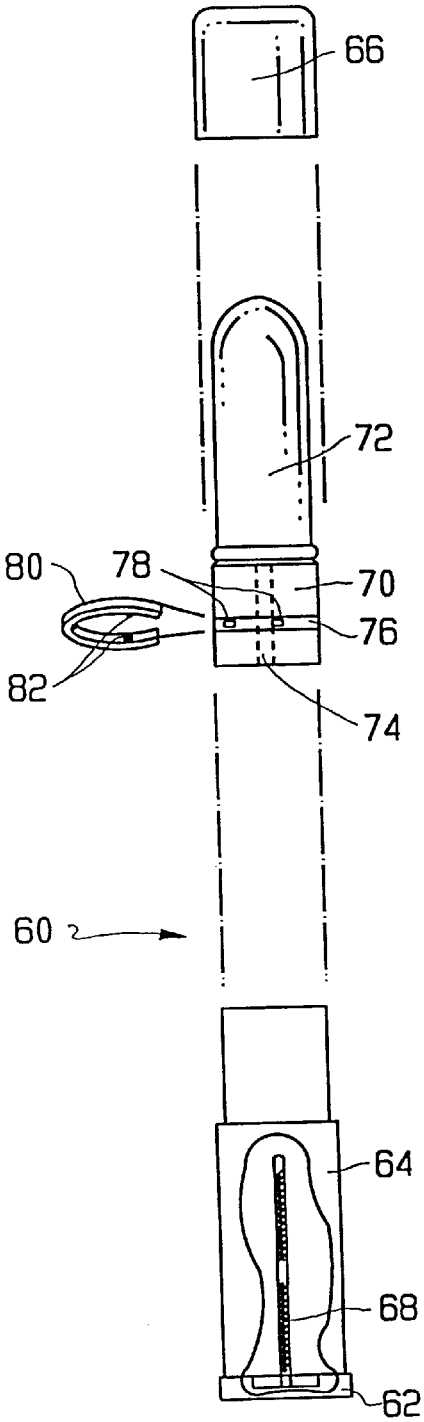
FIG. 5 is exploded view of the embodiment of FIG. 1 used with another type of expellant holder.

The above described embodiments are also applicable to the type of expellant holders normally used for lip balms, deodorants, antiperspirants or glue-sticks. As shown in FIG. 5, expellant holder 60 comprises rotatable base 62, outer shell 64 and cap 66. Fixedly attached to base 62 is threaded member 68. Holder 60 also contains receiving cup 70 to receive the expendable mass 72. It will be noted that receiving cup 70 is substantially similar to receiving cup 22 shown in FIGS. 1–4. Receiving cup 70 also defines a threaded aperture 74 for receiving threaded member 68.

As base 62 is rotated with respect to outer shell 64, threaded member 68 and threaded aperture 74 cooperate to slide cup 70 and expendable mass 72 in the longitudinal direction. It can be appreciated that rotating base 62 relative to outer shell 64 in one direction moves the cup upward and in the opposite direction moves the cup downward.

Also shown in FIG. 5, cup 72 defines a channel 76 having a plurality of apertures 78. Arcuate ring 80 having a plurality of spikes 82 which corresponds to the plurality of apertures 78 is provided to anchor the expendable mass 72 to cup 70. Arcuate ring 80 and channel 76 are substantially identical to those described above and depicted in FIGS. 1 and 2.

Figure 6:
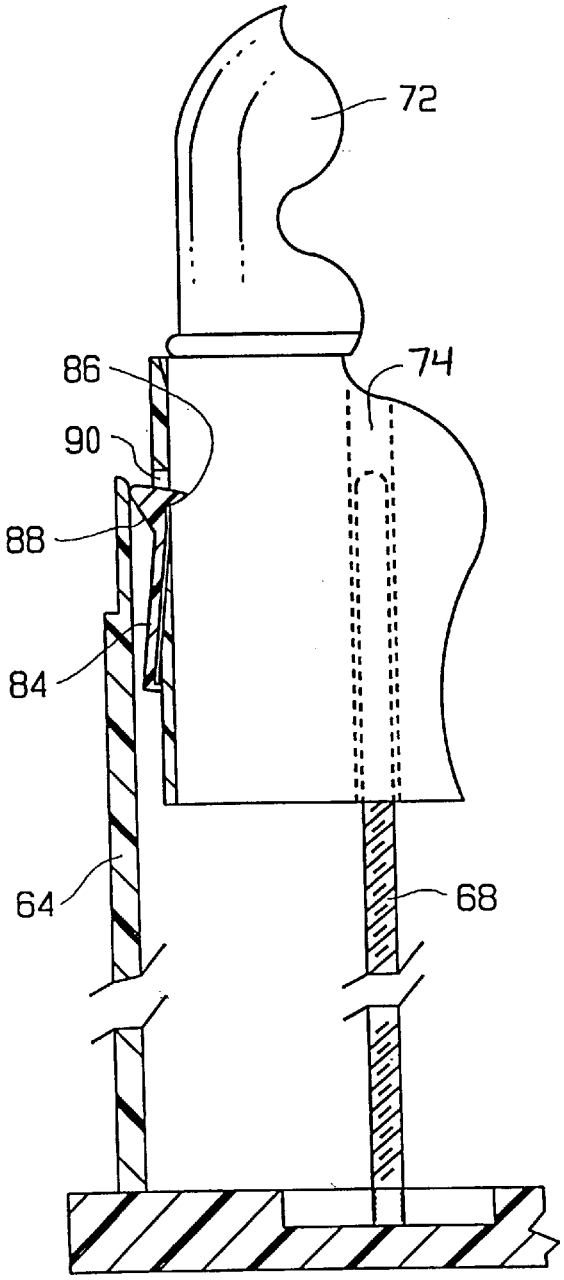
FIG. 6 is partial cross-sectional view of the embodiment of FIGS. 3 and 4 used with the expellant holder shown in FIG. 5.

The embodiment shown in FIGS. 3 and 4 is also applicable to expellant holder 60 as shown in FIG. 6. Cup 70 comprises a plurality of arms 84. Each arm 84 has a spike 86 and a cam surface 88 disposed opposite from spike 86. Cup 70 also defines a plurality of apertures 90 which corresponds to the plurality of spikes 86. As cup 70 is withdrawn into outer shell 64, cam surface 88 cooperates with the top end of outer shell 64 to drive spike 86 into the expendable mass 72 through aperture 90. Arms 84 and apertures 90 are substantially identical to arms 50 and apertures 56 depicted in FIGS. 3 and 4.

In yet another embodiment of the invention the receiving cup defines at least one pair of apertures disposed circumferentially opposite from one another on the receiving cup. The expendable mass is anchored to the receiving cup by means of a long spike having a length that is substantially the same as the outer diameter of the receiving cup such that the ends of the spike cooperate with the wall of the receiving cup to prevent movement of the expendable mass relative to the receiving cup.

It is clear from the discussion above that the spikes anchor the lipstick or other expendable masses to the receiving cup after the expendable mass is received in the cup. However, the liquid expendable mass may be poured into a mold which contains a receiving cup and anchoring mechanism including spikes according to the present invention at one end of the mold. Thus, after the expendable mass solidifies the spikes are embedded in the solid mass.

Further, the arcuate snap ring and spike-arms described above can be made out of any materials having sufficient rigidity to penetrate and retain the expendable mass inside the receiving cup, e.g., aluminum, other metals or hard plastics.

While various embodiments of the present invention are described above, it is understood that various features of the preferred embodiments can be used singly or in any combination thereof. Thus the present invention will not be limited to only the specifically embodiments depicted herein.

What is claimed is:

1. An expellant holder for storing, advancing, and retracting an expendable mass, which holder comprises:

a receiving cup defined by a wall portion and a base portion, said receiving cup for holding the expendable mass, said receiving cup being slideably disposed within a housing;

means for advancing the receiving cup and expendable mass until at least a portion of the expendable mass has advanced outside the housing and for retracting the receiving cup and expendable mass within the housing; and at least one spike disposed on a resilient snap ring, adapted to grasp said wall portion of the receiving cup, with said at least one spike penetrating the expendable mass through at least one corresponding aperture defined in the wall portion of the receiving cup such that the spike remains embedded in the expendable mass during advancing and retracting of said receiving cup to anchor the mass therein.

2. The expellant holder according to claim 1, wherein the snap ring is received on the receiving cup so that the at least one spike penetrates the at least one aperture, said snap ring being retained substantially around the exterior of the wall portion of the receiving cup by resilient pressure action on said snap ring.

3. The expellant holder according to claim 2, wherein the receiving cup defines a channel to receive the snap ring and the snap ring is retained in the channel.

4. An expellant holder for storing, advancing, and retracting an expendable mass contained therein, which holder comprises:

a receiving cup defined by a wall portion and a base portion, said receiving cup for holding the expendable mass and having defined therein at least one aperture on the wall portion;

an inner cylinder which slideably receives the receiving cup, wherein the receiving cup comprises at least one lug, said at least one lug is slideably disposed within at least one longitudinal channel defined on the inner cylinder and wherein the inner cylinder is fixedly attached to a base on the expellant holder;

a second cylinder rotationally disposed to the inner cylinder, wherein the second cylinder defines at least one spiral channel, said at least one spiral channel slideably receives said at least one lug, wherein a rotation of the inner cylinder relative to the second cylinder causes the receiving cup to move along the longitudinal channel and along the spiral channel; and at least one spike disposed on a resilient snap ring, said snap ring adapted to grasp said wall portion of the receiving cup, wherein said at least one spike penetrates the expendable mass through said at least one aperture such that the spike remains embedded in the expendable mass during advancing and retracting of said receiving cup to anchor the mass therein.

5. The expellant holder according to claim 4, wherein the snap ring is received on the receiving cup so that the at least one spike penetrates the at least one aperture, said snap ring being retained substantially around the exterior of the wall portion of the receiving cup by resilient pressure action of said snap ring.

6. The expellant holder according to claim 5, wherein the receiving cup defines a channel to receive the snap ring and the snap ring is retained in the channel.

7. The expellant holder according to claim 6, wherein the expellant holder further comprises an outer cylinder disposed to the outside of the second cylinder.

8. An expellant holder for storing, advancing, and retracting an expendable mass, which holder comprises:

a receiving cup defined by a wall portion and a base portion, said receiving cup for holding the expendable mass and having a first threaded aperture and at least one second aperture defined on the wall portion, wherein the receiving cup is slideably disposed within the expellant holder;

a base member rotationally attached to an outer shell of the expellant holder, said base member comprising a threaded member cooperating with the first threaded aperture for advancing and retracting the receiving cup when the base member is rotated relative to the outer shell; and at least one spike disposed on a resilient snap ring, said snap ring being adapted to grasp said wall portion of the receiving cup such that said at least one spike penetrates the expendable mass through said at least one second aperture and remains embedded in the expendable mass during advancing and retracting of said receiving cup to anchor the mass therein.

9. The expellant holder according to claim 8, wherein the snap ring is received on the receiving cup so that the at least one spike penetrates through the at least one aperture, said snap ring being retained substantially around the exterior of the wall portion of the receiving cup by resilient pressure action of said snap ring.

10. The expellant holder according to claim 9, wherein the receiving cup defines a channel to receive the snap ring and the snap ring is retained in the channel.

* * * * *